United States Patent [19]

Hassler et al.

[11] 4,388,603

[45] Jun. 14, 1983

[54] CURRENT LIMITING FUSE

[75] Inventors: Stephen P. Hassler, Muskego; Theodore O. Sokoly, Mayville, both of Wis.

[73] Assignee: McGraw-Edison Company, Rolling Meadows, Ill.

[21] Appl. No.: 263,877

[22] Filed: May 15, 1981

[51] Int. Cl.[3] ..... H01H 85/04

[52] U.S. Cl. ..... 337/158; 337/162

[58] Field of Search ..... 337/158, 159, 160, 161, 337/162

[56] References Cited

U.S. PATENT DOCUMENTS

| | | | |
|---|---|---|---|
| 3,243,552 | 3/1966 | Mikulecky | 337/162 |
| 3,813,627 | 5/1974 | Koch | 337/160 X |
| 3,978,443 | 8/1976 | Dennis et al. | 337/159 X |
| 4,028,655 | 6/1977 | Koch | 337/160 |

*Primary Examiner*—George Harris

*Attorney, Agent, or Firm*—Charles W. MacKinnon; James Gabala; Jon C. Gealow

[57] ABSTRACT

A current limiting fuse has a main fusible element and an auxiliary fusible element each helically wound over an insulative support member. Each end of the auxiliary element is connected to conductive metal clips or electrodes in which blocks of metal oxide varistor material are fixedly secured and placed in contact with the main fusible element. Subsequent to the initial burn back of the main fusible element, the metal oxide varistors precisely initiate electrical arcs between the terminal clips at the ends of the auxiliary fusible element and the main element at points adjacent to these terminal clips. The presence of these arcs quickly sever the main element or elements at these points thereby producing additional burnback areas in the main fusible element or elements.

10 Claims, 3 Drawing Figures

CURRENT LIMITING FUSE

BACKGROUND OF THE INVENTION

This invention relates to fuses, and more particularly to current limiting fuses having auxiliary fusible elements.

Current limiting fuses of the type discussed herein conventionally include main and auxiliary fusible elements, each wound in helical fashion along an insulative core or the like support member. The core and fusible elements are embedded in a granular inert material of high dielectric strength, such as sand or finely divided quartz. The fusible elements usually take the form of one or more thin conductive strips or wires of silver, wound on the supporting core, which is made of high temperature resistant insulating material. The main and auxiliary fusible elements may each include one or more such conductive strips or wires, with the auxiliary fusible element being spaced apart from the main fusible element to preclude formation of electrical arcs therebetween under fault current conditions of low magnitude. The auxiliary fusible element is separated at its ends from the main fusible element usually by air gaps to produce multiple arc regions or burn back areas in the main fusible element under minimum current operation, thereby more effectively breaking the circuit through the fuse.

A current limiting fuse of the above-mentioned type is shown in U.S. Pat. No. 3,243,552, dated Mar. 29, 1966, to H. W. Mikulecky, assigned to the same assignee as the instant invention. The air gaps disclosed in that patent were formed by a pair of spaced-apart metallic terminals. Another U.S. Pat. No. 3,755,769, dated Aug. 28, 1973, also assigned to the same assignee as the subject invention, provides a more precise control over initiation of arcing action between the main and auxiliary fusible elements through the use of special porous tape members in place of the air gaps.

While the aforementioned arc initiating means provide acceptable control over the arcing action between the main and auxiliary fusible elements of a current limiting fuse of the above described type, it would be desirable if still more precise means could be provided for reliably initiating the formation of an electrical arc to the auxiliary fusible element for the introduction of the auxiliary fusible element into the fuse circuit. It would also be desirable to accurately control more precisely the time at which the auxiliary fusible element is introduced into the fuse circuit during the interruption cycle.

SUMMARY OF THE INVENTION

Accordingly, it is a primary object of the present invention to provide a new and improved current limiting fuse having main and auxiliary fusible elements wound in spaced relation about an insulative core and an improved arc initiating means for creating electrical arcs at the end terminals of the auxiliary fusible element. The presence of the arcs between the terminals of the auxiliary fusible element and the adjacent points of the main elements cause the main element to be quickly melted open at these points. These additional openings increase the effectiveness of the fuse in interrupting the current flow during conditions of relatively low magnitude overcurrent.

It is another object of this invention to provide a current limiting fuse of the above described type which gives greater reliability in the arcing between the main and auxiliary fusible elements during extended periods of slight over-current.

It is a further object of this invention to provide a means for initiating the arc between the main and auxiliary fusible elements at a precise voltage using simple effective and economical components which also provide improved consistency of operating characteristics of the fuse.

In a preferred form of this invention, an improved current limiting fuse is provided which includes main and auxiliary fusible elements wound about an insulative core and embedded in granular inert material of high dielectric strength, such as sand or finely divided quartz. The main fusible element is formed of multiple strips of silver or other material well known to those skilled in the art. The auxiliary fusible element is formed of wires of similar material. A bead of low temperature melting alloy is provided at a predetermined point on the main fusible element, known as the "M-spot" to sever the main fusible element initially through a metalurgical action during periods of prolonged over-current conditions of low magnitude. The auxiliary fusible element is separated from the main fusible element to preclude arc initiation along the lengths thereof during prolonged fault currents of low magnitude. The ends of the auxiliary fusible element are, however, electrically connected to the main fusible element through metallic terminals in which blocks of non-linear resistor material of the metal oxide varistor type are fixedly secured. The metal oxide varistor blocks have a predetermined break down voltage rating. During low magnitude over-current conditions, the main fusible element is severed and a resulting arc is formed across the "M-spot", creating a voltage drop across the main fusible element which is shunted by the auxiliary fusible element. As the voltage drop across the "M-spot" begins to rise and exceeds a predetermined level, the metal oxide varistor blocks become electrically conductive, thereby connecting the auxiliary fusible element in a parallel relation with the "M-spot". Since the metal oxide varistor blocks are relatively short, they will not have a dominant affect on the amount of current that will flow through them. As the voltage across the "M-spot", and also across the varistor blocks increases, the resultant rapid increase in current density within the relativity small cross sectional area of the varistor blocks will quickly cause the thermal capability of the blocks to be exceeded. This will result in the thermal destruction of the blocks and arcs external to the blocks. These arcs will terminate on the main element or elements and quickly cause the main element or elements to be melted open at these points. During this time the initial arc at the "M-spot" in the main fusible element is allowed to cool.

DETAILED DESCRIPTION OF A PREFERRED EMBODIMENT

Figure 1:
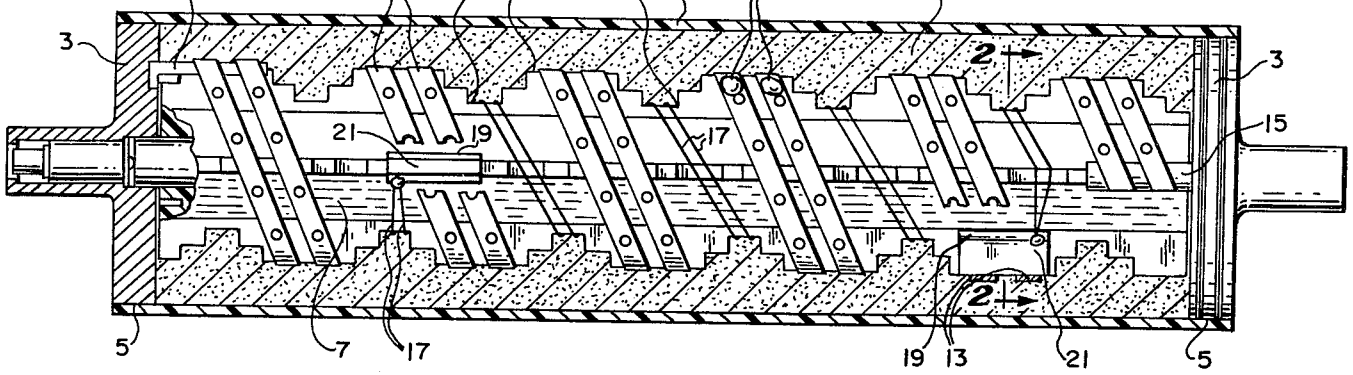
FIG. 1 is a longitudinal, cross-sectional view of a current limiting fuse embodying the new and improved arc initiating blocks according to the invention.
Figure 2:
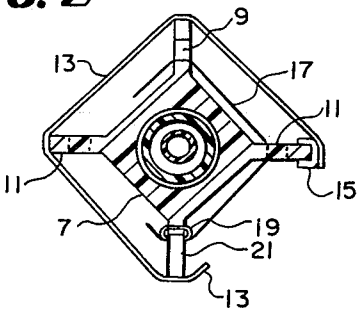
FIG. 2 is a cross-sectional view of the fuse of FIG. 1 taken along the line 2—2.

Referring to the drawings, and more particularly to FIG. 1, a preferred embodiment of a current limiting fuse incorporating the new and improved arc initiating means is shown. The fuse includes a housing 10 which surrounds a central longitudinally extending core 7 with a main fusible element 13 and an auxiliary fusible element 17 wound thereabout. Housing 10 is constructed of a suitable insulative material, such as, as for example, glass, fiber, or glass fiber impregnated with epoxy resin. Core 7 may be of inert material such as porcelain, but it is constructed preferably of an electrical insulating material adapted to evolve gas in the presence of an arc, as is described in U.S. Pat. No. 3,437,971, issued Apr. 8, 1969, and assigned to the same assignee as the instant invention. FIG. 2 shows the core 7 being generally star shaped in cross section, however, other cross-sectional shapes, such as rectangular or circular, may be employed.

Core 7 is joined to metallic end pieces, or terminals 3 by an epoxy adhesive or other suitable sealing material. Housing 10 is also joined to the metallic end pieces with an epoxy adhesive 5 or other suitable sealing material. Housing 10 is sufficiently rigid to give support to the entire internal structure. The space between housing 10 and core 7 is filled with granular inert or refractory material 23 of high dielectric strength, such as, for example, sand or finely divided quartz. Material 23 serves to isolate the fusing and arcing action of elements 13 and 17 from the environment outside housing 10, as is well known to those skilled in the fuse art.

Main fusible element 13 is wound helically on raised shoulders 11 formed on core 7. The main fusible element may be formed of a single or multiple wires or strips of silver, copper or other material well known to those skilled in the art. In the preferred embodiment shown in the drawing, main fusible element 13 comprises multiple strips of silver material.

The ends of main fusible element 13 are fastened to terminals 15 which are coupled to conductive end pieces 3. End pieces 3 are in turn connected into an electrical circuit (not shown).

Figure 3:
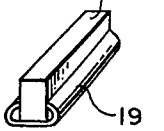
FIG. 3 is a perspective view of an arc initiating block according to the invention.

Auxiliary fusible element 17 is wound helically on depressions 9 formed in core 7. The auxiliary element 17 may also be formed of single or multiple wires or strips of silver, copper or other material well known to those skilled in the art. In the preferred embodiment of the fuse as illustrated, auxiliary fusible element 17 comprises wires of silver material. The ends of auxiliary element 17 are coupled to conductive metal clips or terminals 19 fastened to core 7. Within each terminal 19 is a securely fastened block of non-linear resistor material 21, the upper surface of which is pressed against the main fusible element 13 for electrical connection therebetween. FIGS. 1 and 2 illustrate the positions for terminals 19, non-linear resistor blocks 21, and main fusible element 13. FIG. 3 illustrates a subassembly of a metallic terminal 19 and a non-linear resistor block 21. The non-linear resistor blocks are preferably formed of zinc oxide resistor material, each being of the appropriate length to initiate current flow through the auxiliary fusible element at the preferred time during the interruption process and of the appropriate cross sectional area that an arc external to the block will be created at the preferred time relative to the start of current flow through the auxiliary fusible element. Other suitable non-linear resistive material may be used as well, however.

At a predetermined point on each strip of main fusible element 13 known as the "M-spot", a bead of low temperature melting alloy 25 is provided. In the case of small overload currents, the strips comprising main fusible element 13 sever and burn back from this point. It is difficult in high voltage applications to quench this single resulting arc. To encourage the quenching of this arc, non-linear resistor blocks 21 are provided. Each has a predetermined breakdown voltage at which it begins to conduct current thereby diverting the fault current away from the aforementioned arc and allowing it to cool. The predetermined current carrying capacity of the non-linear resistor blocks 21 is almost immediately exceeded by the fault current that flows through the blocks and the auxiliary fusible element 17. The disruptive discharge through the non-linear resistor blocks 21 causes them to break down, either flashing over or destroying themselves to establish arcing to the main element 13 at their locations, thereby eventually creating additional gaps in the main fusible element 13. The advantages of forming these additional arcs and of diverting current away from the first arc formed at the "M-spot" is fully discussed in U.S. Pat. to Mikulecky No. 3,243,552, referred to heretofore.

While a particular embodiment of the invention has been shown and described, it should be understood that the invention is not limited thereto since modifications thereof may be made. It is therefore contemplated to cover any and all modifications as fall within the true spirit and scope of the appended claims.

We claim:

1. A current limiting fuse comprising a main fusible element of a predetermined length, element interrupting means for interrupting the flow of current through said main fusible element in response to a prolonged over-current condition in said main fusible element, said element interrupting means being located at a predetermined point along said main fusible element, an auxiliary fusible element having first and second ends and non-linear resistor means having a predetermined voltage break down level, each end of said auxiliary fusible element being connected electrically to said main fusible element at points therealong on opposite sides of said element interrupting means, at least one of said first and second ends of said auxiliary fusible element being connected electrically to said main fusible element through said non-linear resistor means.

2. A current limiting fuse as recited in claim 1 wherein each of said first and second ends of said auxiliary fusible element is connected electrically to said main fusible element through said non-linear resistor means.

3. A current limiting fuse as recited in claim 1 wherein said non-linear resistor means includes a conductive clip and an elongated non-linear resistor block disposed within said clip.

4. A current limiting fuse as recited in claim 1 wherein said non-linear resistor means includes a metal oxide varistor block.

5. A current limiting fuse as recited in claim 4 wherein said metal oxide varistor block comprises zinc oxide.

6. A current limiting fuse as recited in claim 1 wherein said means for interrupting the flow of current through said main fusible element in response to a prolonged over-current condition in said main fusible element includes a bead of low temperature melting alloy in intimate contact with said main fusible element.

7. A current limiting fuse comprising an elongated housing, electrical terminals for electrical connection of said fuse into an electrical circuit, a core extending longitudinally within the housing, a main fusible element of a predetermined length connected to said electrical terminals and helically wound around said core, current interrupting means for interrupting the flow of current through said main fusible element in response to a prolonged over-current condition in said main fusible element, said current interrupting means being located at a predetermined point along said main fusible element, non-linear resistor means having a predetermined breakdown level, an auxiliary fusible element having first and second ends for electrical connection thereto, said auxiliary fusible element being helically wound around a portion of said core and electrically connected to said main fusible element at said first and second ends, at points along said main fusible element on opposite sides of said current flow interrupting means, at least one of said ends of said auxiliary fusible element being connected electrically to said main fusible element through said non-linear resistor means.

8. A current limiting fuse as recited in claim 7 wherein said core includes a plurality of depressions and shoulders and wherein said main fusible element includes a pair of elongated metallic strips helically wound upon said shoulders of said core.

9. A current limiting fuse as recited in claim 8 wherein said auxiliary fusible element includes a pair of metallic wires helically wound around said core upon said depressions of said core.

10. A current limiting fuse as claimed in claim 7 wherein said non-linear resistor means comprises first and second non-linear resistor blocks, said first non-linear resistor block being interposed between said first end of said auxiliary fusible element and a point in said main fusible element and said second non-linear resistor block being interposed between said second end of said auxiliary fusible element and a second point in said main fusible element.

* * * * *